US008712303B2

(12) United States Patent
Ando et al.

(10) Patent No.: US 8,712,303 B2
(45) Date of Patent: Apr. 29, 2014

(54) IMAGE HEATING DEVICE

(75) Inventors: Atsutoshi Ando, Yokohama (JP); Shoichiro Ikegami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 13/232,596

(22) Filed: Sep. 14, 2011

(65) Prior Publication Data

US 2012/0063823 A1 Mar. 15, 2012

(30) Foreign Application Priority Data

Sep. 15, 2010 (JP) ..... 2010-206633

(51) Int. Cl.
*G03G 15/20* (2006.01)

(52) U.S. Cl.
USPC ..... 399/330

(58) Field of Classification Search
USPC ..... 399/329, 330, 328
See application file for complete search history.

(56) References Cited

U.S. PATENT DOCUMENTS

| | | | | |
|---|---|---|---|---|
| 5,570,171 | A | 10/1996 | Kusumoto et al. | |
| 6,083,588 | A | 7/2000 | Kagawa et al. | |
| 6,542,712 | B2 | 4/2003 | Kamijo et al. | |
| 7,177,579 | B2 | 2/2007 | Uchida et al. | |
| 7,209,696 | B2 | 4/2007 | Umezawa et al. | |
| 7,406,287 | B2 | 7/2008 | Matsumoto et al. | |
| 7,428,390 | B2 | 9/2008 | Ando | |
| 7,512,370 | B2 | 3/2009 | Shimizu et al. | |
| 7,570,895 | B2 | 8/2009 | Ando et al. | |
| 7,792,448 | B2 | 9/2010 | Ando et al. | |
| 2002/0061211 | A1 | 5/2002 | Kamijo et al. | |
| 2007/0065193 | A1 * | 3/2007 | Jang et al. | 399/329 |
| 2007/0196145 | A1 | 8/2007 | Matsumoto et al. | |
| 2011/0100972 | A1 | 5/2011 | Ikegami et al. | |
| 2012/0076555 | A1 | 3/2012 | Ikegami et al. | |

FOREIGN PATENT DOCUMENTS

| | | | |
|---|---|---|---|
| JP | 7271225 | A | 10/1995 |
| JP | 8110721 | A | 4/1996 |
| JP | 8241000 | A | 9/1996 |
| JP | 2002-082551 | A | 3/2002 |
| JP | 2007219401 | A | 8/2007 |
| JP | 2008020789 | A | 1/2008 |

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image heating device includes a heating rotatable member; and a pressing pad contacted to said heating rotatable member and forming a nip with said heating rotatable member to nip and feed a recording material, said pressing member being provided with an electroconductive material dispersed resin material layer contacting said heating rotatable member.

4 Claims, 6 Drawing Sheets

IMAGE HEATING DEVICE

FIELD OF THE INVENTION AND RELATED ART

The present invention relates to an image heating device used by an image forming apparatus such as a copying machine, a laser beam printer, etc., which uses an electrophotographic image formation process, an electrostatic recording process, or the like image formation process.

There are various image heating devices, for example, a fixing device for heating an unfixed toner image on a sheet of recording medium in order to fix the toner image to the sheet, and a glossing device for heating a fixed image on a sheet of recording medium in order to increase the image in gloss.

An image heating device of the so-called heat roller type, and an image heating device of the so-called film heating type, have long been used as a fixing device by an image forming apparatus which uses an electrophotographic image forming method, an electrostatic image recording method, or the like.

Further, there has been proposed to replace a pressure roller used by a conventional fixing device of the so-called heat roller type, with a pressure pad, in order to reduce a conventional fixing device of the so-called heat roller type in size, for special efficiency. A pressure pad is a stationary member for applying pressure to a sheet of recording medium while the sheet is conveyed between itself and a heat roller (so-called pad type).

Unlike a fixing device of the so-called heat roller type and the like, a fixing device which uses a stationary pad to apply pressure to a sheet of recording medium and an unfixed toner image thereon does not require that a heat source or the like is placed within a fixation roller. Therefore, it makes it possible to reduce a heat roller in diameter to reduce the heat roller in thermal capacity. Further, a pressure pad is simpler in structure than other pressure applying members. Therefore, not only can it simplify an image heating device (fixing device) in overall structure, but also, reduce an image heating device in size and cost. Therefore, it is reasonable to say that an image fixing method which uses a pressure application pad is suitable to reduce a fixing device in warm up time and energy consumption.

One of the structures for a fixing device which uses a pressure application pad as a pressure applying member is listed in Japanese Laid-open Patent Application 2008-20789. According to this application, a pressure pad is molded of an adiabatic substance, such as resin, in a single-piece, in order to ensure that even after a pressure pad is frictionally worn through usage, it does not reduce a fixing device in recording medium conveyance performance. However, a pressure pad, such as the one disclosed in the application, suffers from the following problem. If a pressure pad is formed of an adiabatic substance, in particular, a resinous substance, the nip of a fixing device is likely to fail to properly nip a sheet of recording medium, causing thereby a sheet of recording medium to often stop before the nip (nipping error). Thus, the inventors of the present invention earnestly studied this phenomenon, and discovered that one of the factors related to "nipping error" is that the surface of a pressure pad becomes electrically charged, whereby a sheet of recording medium is adhered to the pressure pad by the electrostatic force generated by the electrical charge of the pressure pad.

More specifically, the surface of a pressure pad is electrically charged by the friction between the surface of the pressure pad and the peripheral surface of the fixation roller which is a rotational heating member. As a result, an electrostatic force which adheres a sheet of recording medium to the surface of the pressure pad develops. If the sum of the amount of this electrostatic force and the amount of the friction between the pressure pad and a sheet of recording medium exceeds the amount of force which works in the direction to push the sheet of recording medium into the fixing device (fixation nip), the "nipping error" is likely to occur, in particular, in a case where the distance between the transfer station and fixing device is large, and therefore, it is easier for a sheet of recording medium to deform before it enters the fixing device (fixation nip), in a case where the transfer station is low in internal pressure, being therefore weaker in recording medium conveyance force.

The following has been known: Until a certain length of time elapses after a fixing device is started, the amount of electrical charge of a pressure pad does not become substantial, and therefore, "nipping error" does not occur. However, as the fixing device increases in the length of time it is being continuously used for a certain length of time, its pressure pad increases in potential level, which in turn increases the amount of electrostatic force between the pressure pad and a sheet of recording medium on the pressure pad. Consequently, the fixing device increases in the probability with which it suffers from "nipping error".

As for a means for improving a fixing device of the so-called pressure pad type in terms of "nipping error", it is possible to plate the pressure pad with a metallic substance, or use a metallic substance as the material for the portion of the pressure pad, which contacts a heating member. However, if a metallic substance is used as the material for the portion of the pressure pad of a fixing device, which contacts a heating member, the peripheral surface of the heating member of the fixing device is frictionally worn at a higher rate. As the peripheral surface of the heating member wears, the heating member reduces in recording medium conveyance force, that is, the amount of force it can apply to a sheet of recording medium to convey the sheet. Therefore, plating the pressure pad of a fixing device with a metallic substance reduces the fixing device in recording medium conveyance force. Further, a metallic substance is inferior in its ability to allow toner particles, paper dust, and the like to part from itself. Therefore, as a substantial number of sheets of recording medium are conveyed through a fixing device of the pressure pad type, toner particles, paper dust, and the like are likely to cumulatively adhere to the downstream side of the recording medium backing surface of the pressure pad, relative to the fixation nip, in terms of the recoding medium conveyance direction, and contaminate a sheet of recording medium.

SUMMARY OF THE INVENTION

Thus, the primary object of the present invention is to provide an image heating device which is unlikely to fail to properly nip a sheet of recording medium, being therefore capable of reliably conveying a sheet of recording medium, and is unlikely to contaminate a sheet of recording medium.

According to an aspect of the present invention, there is provided an image heating device comprising a heating rotatable member; and a pressing pad contacted to said heating rotatable member and forming a nip with said heating rotatable member to nip and feed a recording material, said pressing member being provided with an electroconductive material dispersed resin material layer contacting said heating rotatable member.

According to another aspect of the present invention, there is provided an image heating device comprising a heating rotatable member; and a pressing pad contacted to said heating rotatable member and forming a nip with said heating rotatable member to nip and feed a recording material, said pressing member being provided with an electroconductive material dispersed resin material layer contacting said heating rotatable member in a region upstream of the nip with respect to a feeding direction of the recording material.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described with reference to the appended drawings, in which the corresponding components, their portions, etc., of the image forming apparatuses are given the same referential code.

Embodiment 1

(Image Forming Apparatus)

Figure 4:
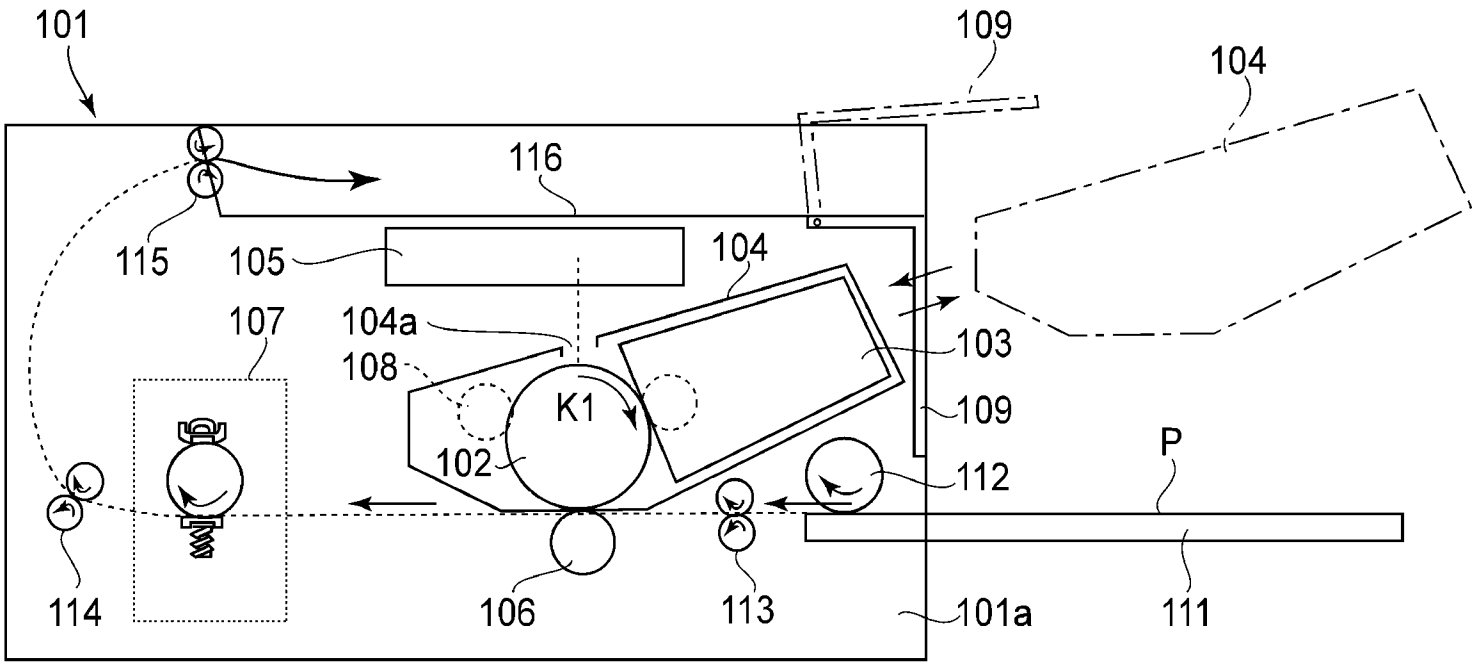
FIG. 4 is a schematic sectional view of the image forming apparatus having an image heating device as a fixing device, at a plane perpendicular to the recording medium conveyance direction. It shows the general structure of the apparatus.

FIG. 4 is a schematic sectional view of a typical image forming apparatus having an image heating device in accordance with the present invention. It shows the general structure of the apparatus. This image forming apparatus is an electrophotographic laser beam printer.

The printer 101 in this embodiment receives the information of the image to be formed, from an apparatus (unshown), such as a host computer, which is outside the main assembly 101*a* of the printer. The printer 101 carries out one of the known electrophotographic image formation processes to record an image on a sheet P of recording medium, based on the received information of the image to be formed.

The printer 101 employs a process cartridge 104. The process cartridge 104 has: an electrophotographic photosensitive member 102, as an image bearing member, which is in the form of a drum; a primary charging system 108; and a developing device 103. The printer 101 has also a laser scanner unit 105. The laser scanner unit 105 forms on the peripheral surface of the photosensitive drum 102, an electrostatic latent image which reflects the information of the image to be formed. As described above, the information of the image to be formed, which hereafter will be referred to simply as "image information" is provided by the aforementioned image information providing apparatus. Further, the printer 101 has a transfer member 106 and a fixing device 107. The transfer member 106 is for transferring an image onto the sheet P of recording medium. It is in the form of a roller, and is rotatable. The fixing device 107 is a thermal fixing device which is for fixing an unfixed image on the sheet P of recording medium to the sheet P by the application of heat and pressure to the sheet P and the image thereon.

Next, the image formation sequence carried out by the printer 101 is described. As the printer 101 receives a print signal, the photosensitive drum 102 begins to be rotated in the clockwise direction indicated by an arrow mark K1 at a preset peripheral velocity. At the same time as the photosensitive drum 102 begins to be rotated, the peripheral surface of the photosensitive drum 102 begins to be uniformly charged to preset polarity and potential level by the primary charging system 108 to which a preset bias is being applied. In this embodiment, the polarity to which the peripheral surface of the photosensitive drum 102 is charged is negative. Thus, an electrostatic latent image is developed in reverse. That is, after the uniformly charged area of the peripheral surface of the photosensitive drum 102 is exposed by the laser scanner unit 105, the developer (toner) is adhered to the exposed points of the peripheral surface of the peripheral surface of the photosensitive drum 102.

Next, the uniformly charged area of the peripheral surface of the photosensitive drum 102 is scanned (exposed) by the scanner unit 105 according to the image information received from the image information providing apparatus. As a given point of the uniformly charged area of the peripheral surface of the photosensitive drum 102 is exposed, it is reduced in potential, becoming therefore positive relative to an unexposed point. As a result, an electrophotographic latent image, which reflects the image information, is effected on the peripheral surface of the photosensitive drum 102. Meanwhile, the developer in the developing device 103 is negatively charged. The negatively charged developer is adhered to the exposed points of the uniformly charged area of the peripheral surface of the photosensitive drum 102, which are positive relative to the unexposed points of the uniformly charged area of the peripheral surfaces of the photosensitive drum 102; the exposed points are developed. Consequently, the electrostatic latent image on the peripheral surface of the photosensitive drum 102 is developed into a visible image; a visible image is formed of the developer on the peripheral surface of the photosensitive drum 102.

Meanwhile, a sheet conveyance roller 112 is driven with a preset timing, whereby a sheet P of recording medium is fed into the main assembly 101*a* from a sheet feeder cassette 111 while being separated from the rest of the sheets P in the cassette 111. The sheet feeder cassette 111 is capable of storing in layers multiple sheets P of recording medium. It is removably mountable in the main assembly 101*a* of the printer 101. After being fed into the main assembly 101*a* from the sheet feeder cassette 111, the sheet P of recording medium is sent to a pair of registration rollers 113, and is temporarily held there. Then, it is released with a preset timing by the pair of registration rollers 113 to be conveyed to the transfer nip, that is, the nip formed between the peripheral surface of the photosensitive drum 102 and image transferring member 106.

Then, it is conveyed through the transfer nip while remaining pinched between the photosensitive drum 102 and image transferring member 106. It is while the sheet P is conveyed through the transfer nip that the toner image on the photosensitive drum 102 is transferred onto the sheet P by the image transferring member 106 as if it is peeled away from the photosensitive drum 102.

After the transfer of the toner image onto the sheet P of recording medium, the toner image (unfixed) is thermally fixed to the sheet P by the fixing device 107. Then, the sheet P is conveyed further by a pair of rollers 114 which are rotatably supported on the downstream side of the fixing device 107 in terms of the recording medium conveyance direction, and then, is discharged from the apparatus main assembly 101*a* by a pair of discharge rollers 115, into a delivery tray 116 in such a manner that it is layered on the sheets P in the tray 116. The delivery tray 116 is an integral part of the top wall of the main assembly 101*a* of the printer 101. The discharging of the sheet P into the delivery tray 116 concludes the image formation sequence.

(Process Cartridge)

Opening a cover 109, shown in FIG. 4, makes it possible for the process cartridge 104 to be mounted into, or removed from, the main assembly 101*a* of the printer 101.

(Image Heating Device)

Figure 1:
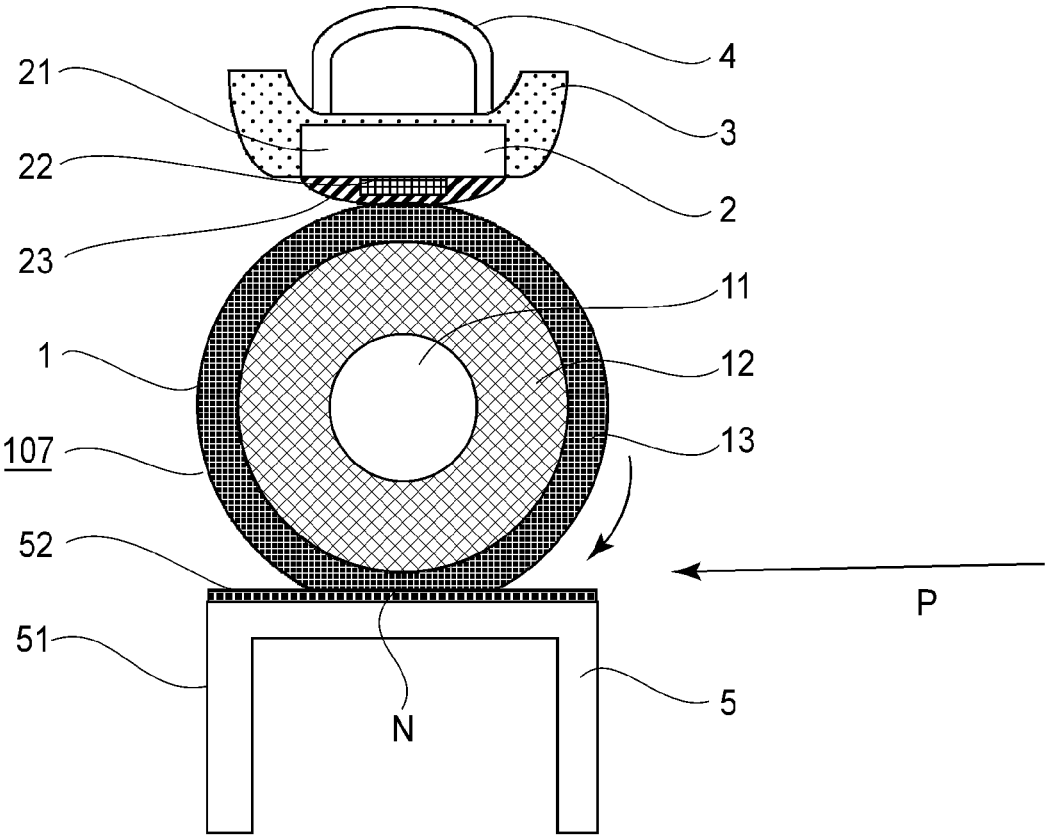
FIG. 1 is a schematic sectional view of the fixing apparatus in the first preferred embodiment of the present invention, at a plane perpendicular to the axial line of the heating member.

Next, referring to FIG. 1, the structure of the fixing device 107 which is an image heating device in accordance with the present invention is described. The fixing device 107 is for thermally fixing an unfixed toner image formed by an ordinary electrophotographic image forming method. More specifically, the sheet P of recording medium, on which an unfixed toner image is present, is conveyed through the fixing device 107 by an unshown recording medium conveying means, from the right-hand side of the fixing device 107 (with reference to FIG. 1). As the sheet P is conveyed through the fixing device 107, the unfixed toner image is thermally fixed to the sheet P. Designated by a referential numeral 1 is a fixation roller as a rotatable heating member which heats the sheet P and the toner image thereon while conveying the sheet P. Designated by a referential numeral 2 is a heater as a means for externally heating the fixation roller 1 of the fixing device 107. Designated by a referential numeral 3 is a heater holder as a member for holding the heater 2. Designated by a referential numeral 5 is a pressure pad as a stationary pressure applying member, which opposes the fixation roller 1.

The fixation roller 1 comprises a metallic core, an adiabatic elastic layer 12, and at least one thermally conductive layer 13. The material for the metallic core 11 is aluminum, iron, SUS (stainless steel) SUM (free-cutting steel), or the like. The adiabatic elastic layer 12 is formed of a substance which is low in thermal conductivity. It covers the entirety of the peripheral surface of the metallic core 11. The thermally conductive layer 13 covers the peripheral surface of the elastic layer 12.

The material for the adiabatic elastic layer 12 is balloon rubber, sponge rubber, or the like, for example. Balloon rubber is a mixture of silicone rubber and hollow filler (such as micro balloons). Sponge rubber is formed by causing silicon rubber to foam with the use of a mixture of water and foaming agent. Further, the material for the adiabatic elastic layer 12 may be a solid rubber which is low in thermal conductivity.

More specifically, as the material for the thermally conductive layer 13, a highly thermally conductive substance made by mixing highly thermally conductive filler into silicon rubber or fluorinated rubber is used. Using the above-described substance as the material for the thermally conductive layer 13 makes it possible to provide a fixation roller which is high in thermal conductivity and can generate friction which is necessary to convey the sheet P of recording medium through a fixing device (fixation nip). In this embodiment, the metallic core 11 is 6 mm in diameter. The adiabatic elastic layer formed of the balloon rubber (rubber which contains micro-balloons), on the peripheral surface of the metallic core 11, is 3 mm in thickness. The layer of highly thermally conductive silicone rubber formed on the peripheral surface of the balloon silicon rubber layer 12, of the silicon rubber made by dispersing aluminum particles, as thermally conductive filler, in the silicon rubber, is 150 μm in thickness.

The heater 2 has a substrate 21 and a layer 22 of heat generating resistor. The substrate 21 is long and narrow, and its lengthwise direction is perpendicular to the recording medium conveyance direction. It is formed of dielectric ceramic (such as alumina and aluminum nitrate), or heat resistant resin (such as polyimide, PPS, and liquid polymer). The layer 22 of heat generating resistor is formed of an electrically conductive substance, such as Ag/Pd (silver-palladium), $RuO_2$, $Ta_2N$, on the surface of the substrate 21, with a method such as screen printing. It also is in the form of a piece of wire, or long and narrow strip. It extends in the lengthwise direction of the substrate 21. Further, the heater 2 has a dielectric protective layer 23 which covers the entirety of the surface of the layer 22 of heat generating resistor to protect and insulate the layer 22. The dielectric protective layer 23 is formed of a dielectric substance such as glass, polyimide, or the like.

Further, the heater 2 may be provided with a parting layer (unshown), as a surface layer, which covers the entirety of the dielectric protective layer 23, not only to reduce the friction between the heater 2 and the peripheral surface of the fixation roller 1, but also, to prevent the unfixed toner on the sheet P of recording medium, from adhering to the heater 2.

In the case of the heater 2 in this embodiment, the substrate 21 is formed of alumina, and the heat generating resistor layer 22 is formed of Ag/Pd. The dielectric protectively layer 23 is formed by coating the surface of the heat generating resistor layer 22 with glass. The heater 2 is held to the heater holder 3 by the substrate 21 in such an attitude that the protective layer 23 of the heater 2 faces the peripheral surface of the fixation roller 1. The heater holder 3 is made of a heat resistant resin such as liquid polymer, PPS, PEEK, or the like. Its lengthwise ends are in engagement with a stay 4 held to the fixing device frame.

Further, the fixing device 107 has a pair of compression springs (unshown), as pressure applying means which apply pressure to the lengthwise end of the stay 4. Thus, the heater holder 3 is kept pressed toward the fixation roller 1. The pressure applied to the stay 4 by the pair of compression springs has to be uniformly transmitted to the heat holder 3 in terms of the lengthwise direction of the heat holder 3. Thus, a rigid substance such as iron, stainless steel, SUM, zinc-coated steel plate, etc., is used as the material for the stay 4. Further, the stay 4 is made U-shaped in cross section, or the like, to further increase it in rigidity.

Since the fixing device 107 is structured as described above, the protective layer 23 of the heater 2 is placed and kept in contact with the peripheral surface of the fixation roller 1, forming thereby a heating nip between the heater 2 and fixation roller 1. Further, since the heater holder 3 is formed of the above descried material and is structured as described above, the heating nip remains uniform in width. In this embodiment, liquid polymer is used as the material for the heater holder 3, whereas the material for the stay 4 is zinc-coated steel plate.

The pressure pad 5, which is a stationary pressure applying member, is made up of a substrate 51 and a recording medium backing layer 52. The substrate 51 is long and narrow, and its lengthwise direction is perpendicular to the recording medium conveyance direction. The recording medium backing layer 52 is on the substrate 51. As for the material for the substrate 51, it may be any substance as long as it is suitable for the formation and positioning of the substrate 51. However, in order to ensure that as the pressure pad 5 is pressed upon the peripheral surface of the fixation roller 1, it forms the heating nip which is uniform in width and internal pressure, the material for the substrate 51 is desired to be more or less rigid. Further, it is required to withstand the high level of temperature to which it is subjected when the recording medium backing layer 52 is formed through a process which includes coating and sintering, as will be described later. Therefore, it is desired that a metallic substance such as iron, stainless steel, SUM, zinc-coated steel plate, or the like is used as the material for the substrate 51.

In this embodiment, the substrate 51 of the pressure pad 5 is made of a piece of zinc-coated steel plate, and is bent in the shape shown in FIG. 1. The pressure pad 5 is under a total pressure of 5 kg applied by the aforementioned pair of compression springs.

The material for the recording medium backing layer 52 is desired to be low in frictional resistance so that it does not impede the conveyance of the sheet P of recording medium by the friction between the recording medium backing layer 52 and the sheet P of recording medium. Further, from the standpoint of preventing the problem that the contaminants such as the toner particles, and the like, having transferred from the sheet P of recording medium onto the fixation roller 1, adhere to the recording medium backing layer 52, the material for the recording medium backing layer 52 is desired to have parting properties. Thus, it is desired that fluorinated resin such as PTFE, FEP, PFA, etc., PEEK (poly ether-ether ketone), PAI (polyamideimide), PI (polyimide), or the like is used as the material for the recording medium backing layer 52. As for the method for forming the recording medium backing layer 52, the recording medium backing layer 52 may be formed by spray-coating the surface of the substrate 51 with the material for the recording medium backing layer 52, or dipping the substrate 51 into the material for the recording medium backing layer 52. Further, it may be formed by making a piece of thin sheet of the material for the recording medium backing layer 52, the thickness of which is in a range of several micrometers—several hundreds of micrometers, and solidly attaching the piece to the substrate 51. Further, the recording medium backing layer 52 is made electrically conductive to prevent the recording medium backing layer 52 from being electrically charged by the friction which occurs between the recording medium backing layer 52 and the peripheral surface of the fixation roller 1 as the fixation roller 1 is rotated.

(Method for Making Recording Medium Backing Layer 51 Electrically Conductive)

The recording medium backing layer 52 is made electrically conductive by dispersing electrically conductive substance (carbon, for example) into the resinous material for the recording medium backing layer 52, with the use of one of the known manufacturing methods, which uses a mixing roller, a pressurized kneader, an extruder, a three roll mill, a homogenizer, a ball mill, a piece mill, or the like, for example. Further, various additives, such as plasticizer, coloring agent, charge inhibitor, aging inhibitor, oxidization inhibitor, reinforcement filler, reaction accelerator, etc., may be added to the material for the recording medium backing layer 52 as necessary.

As the particles for providing the recording medium backing layer 52 with electrical conductivity, minute particles of the following substances can be listed: metallic substance such as aluminum, copper, nickel, and silver; and oxides of electrically conductive metals, such as antimony oxide, indium oxide, tin oxide, titanium oxide, zinc oxide, molybdenum oxide, and potassium titanate; various carbon fiber; carbon black, such as furnace black, lamp black, thermal black, acetylene black, and channel black; and metallic fiber.

Among those substances listed above, carbon black, in particular, electrically conductive amorphous carbon black, is a preferable material for providing the recording medium backing layer 52 with electrical conductivity. The reasons why the electrically conductive amorphous carbon black is preferable among those substances listed above are as follows: First, it is excellent in electrical conductivity, being therefore capable of providing a high polymer with electrical conductivity by being dispersed in the high polymer, and further, the mount of electrical conductivity which it can provide can be somewhat controlled by controlling the amount by which it is dispersed in the high polymer. Secondly, it has a thixotropic effect. Therefore, it remains uniformly dispersed as it is dispersed in a paint made up of high polymer, and also, when and after the paint is coated on the substrate 51.

The proper amount by which carbon black is to be dispersed into the resinous substance as the material for the recording medium backing layer 52 varies depending on the particle diameter of carbon black. However, it is desired to be in a range of no less than one part of carbon black, and no more than 100 parts, per 100 parts of the resinous substance (bonding resin) as the material for the recording medium backing layer 52. It is within this range that the resultant recording medium backing layer 52 is roughly at a preset value in terms of electrical resistance, and also that it is not unsatisfactorily low in mechanical strength (resistant to frictional wear).

In this embodiment, the recording medium backing layer 52, which is 50 μm in thickness, is formed on the substrate 51 by spraying the material made by dispersing carbon into PFA (copolymer of polytetrafluoroethylene and perfluoroalkylvinylether), onto the surface of the substrate 51, and sintering the material on the substrate 51.

Figure 2:
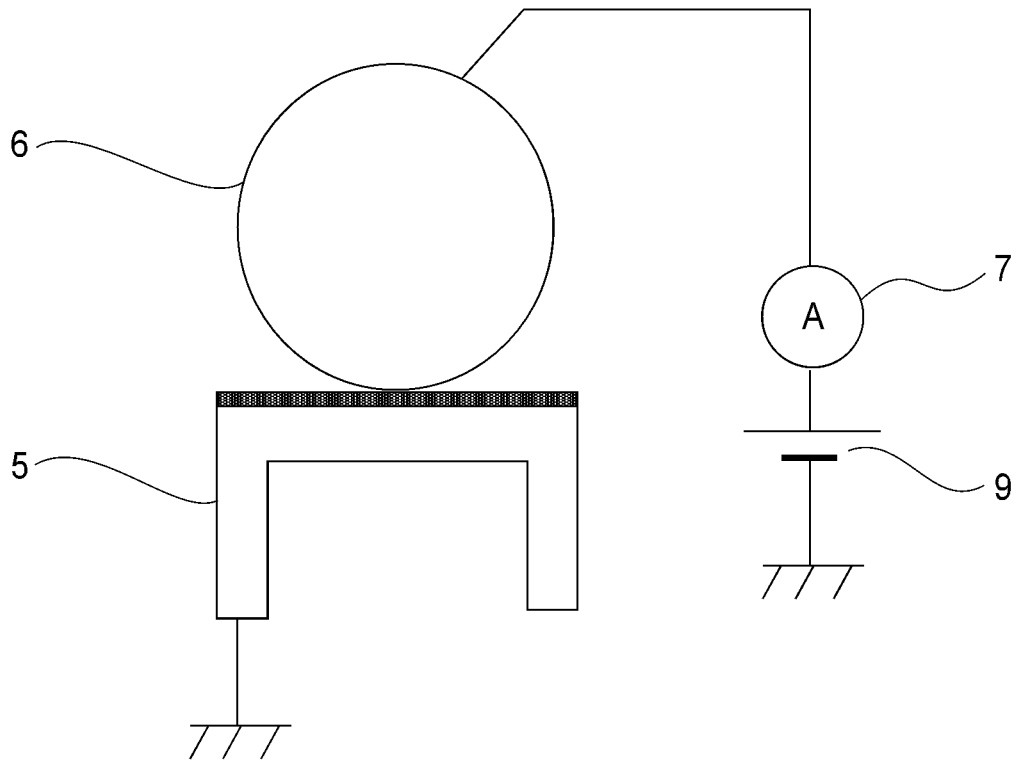
FIG. 2 is a schematic drawing for describing the method for measuring the amount of the electrical resistance of the pressure pad.

FIG. 2 shows the method for measuring the electrical resistance of the pressure pad 5. As will be evident from FIG. 2, first, a roller 6 for measuring the amount of electrical resistance of the pressure pad 5 is stationarily placed in contact with the surface of the recording medium back layer 52 of the pressure pad 5, and is connected to an electrical power source 9 with the presence of an ammeter 7 between the roller 6 and power source 9. Then, 100 V-1,000 V of voltage is applied between the recording medium backing layer 52 and power source 9. The amount of electrical resistance of the pressure pad 5 can be obtained by monitoring the amount of electrical current which flows through the ammeter 7. The roller 6 was made by wrapping the fixation roller 1 in this embodiment with a sheet of aluminum foil. The amount R of the electrical resistance of the pressure pad 5 can be obtained from the following equation, in which I and V stand for the amount of electrical current, and the voltage:

$$R(\Omega)=V/I.$$

In the case of the pressure pad 5 in this embodiment, the amount of the electrical current which flowed through the ammeter 7 when 1,000 V of voltage was applied was roughly 100 μA. Thus, the amount of electrical resistance of the pressure pad 5 is roughly 10 MΩ. Incidentally, the substrate 51 of the pressure pad 5 in this embodiment is metallic. Therefore, the amount of electrical resistance of the pressure pad 5, which can be obtained using the above-described method is the amount of electrical resistance of the portion of the resinous layer (recording medium supporting layer) of the pressure pad 5, which corresponds in position to the fixation nip N. The pressure pad 5 is under the total pressure of 5 kg which is from the unshown pair of compression springs. Thus, it forms the fixation nip N, which is roughly uniform in width and internal pressure in terms of the direction perpendicular to the recording medium conveyance direction. In this embodiment, the pressure pad 5 is grounded. As described above, the fixing device 107 in this embodiment has a pressure applying member 5 (pressure pad), which forms a nip between itself and the peripheral surface of the rotational heating member 1 (fixation roller 1) by being pressed upon the peripheral surface of the rotational heating member, and which conveys the sheet P of recording medium through the nip while keeping the sheet P between itself and rotational heating member 1. The pressure applying member 5 is grounded. The surface of the pressure applying member 5, which is in contact with the rotational heating member 1, is the surface of the recording medium backing layer 52 of the pressure applying member 5, which is formed of a resinous substance in which particles of electrically conductive substance are dispersed.

As an image forming operation is started by the image forming apparatus, the fixation roller 1 begins to be rotated. At the same time, electric power begins to be supplied to the heater 2 while being controlled by an unshown control circuit. Thus, the heater 2 increases in temperature, heating thereby the fixation roller 1. As the temperature of the fixation roller 1 reaches a level high enough for fixation, the sheet P of recording medium on which an unfixed toner image is present is introduced into the fixation nip, and conveyed through the fixation nip while being given heat by the fixation roller 1 and kept pressed against the fixation roller 1 by the pressure pad 5. As a result, the unfixed toner image on the sheet P becomes fixed to the surface of the sheet P.

The image heating device in this embodiment was tested in its nipping performance, using the following method. That is, the image heating device in this embodiment was set in the laser beam printer (commercial name: Laser Jet P1006: product of Hewlett Packard Co., Ltd.), which is the electrophotographic image forming apparatus, and is driven at a process speed of 107 mm/sec. The recording medium was a sheet of Business 4200 paper (commercial name: product of Xerox Co., Ltd.), which was 75 g/m$^2$ in basis weight. In the test, the sheets of recording medium were conveyed through the fixing device 107 at a rate of 17 sheets per minute to test the fixing device 107 in nipping performance. The test results were very satisfactory. That is, while the maximum number (150) of sheets which can be fed per sheet feeder cassette 111 were conveyed through the fixing device 107, the fixing device 107 never failed to properly nip the sheet. Further, the amount of surface potential of the pressure pad 5 measured after the conveyance of 150 sheets was no higher than 1 kV, proving that the pressure pad 5 was hardly charged.

(First Comparative Fixing Device)

For comparison, a pressure pad 5, the recording medium backing layer 52 of which is formed of electrically nonconductive substance, was made. This pressure pad 5 is different from the pressure pad 5 in the first embodiment in that while the recording medium backing layer 52 of the latter is made of electrically conductive PFA, that is, PFA resin in which carbon particles are dispersed, whereas the recording medium backing layer 52 of the former is made of electrically nonconductive PFA resin, that is, PFA resin which does not contain carbon particles.

The first comparative fixing device was set in a laser beam printer similar to that used to test the pressure pad 5 in the first embodiment, and was subjected to the same recording medium conveyance test as the one used to test the pressure pad 5 in the first embodiment. In the case of the first comparative fixing device, the unfixed toner images on only the first several sheets of recording medium were normally fixed. Thereafter, the problem that a sheet of recording medium fails to be properly nipped by the fixation nip of a fixing device and stops at the entrance of the nip frequently occurred. The amount of surface potential level of the pressure pad 5 of this comparative fixing device measured after the problem began was no less than 4 kV.

Figure 3:
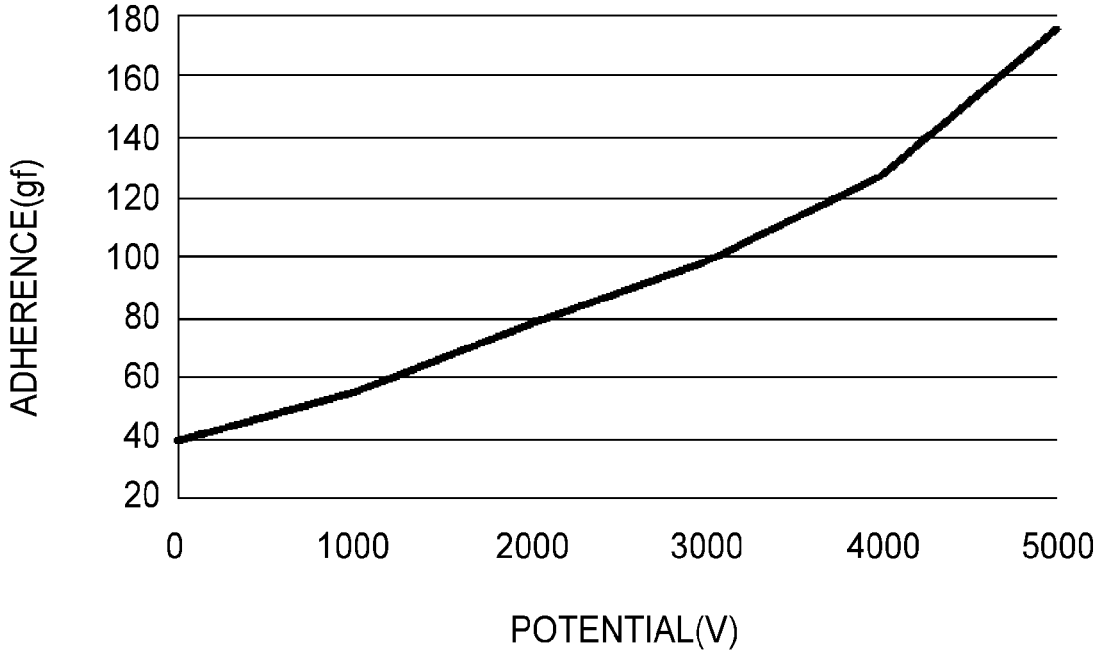
FIG. 3 is a graph which shows the relationship between the potential level of the pressure pad and the amount of electrostatic force which attracts a sheet of recording medium to the pressure pad.

FIG. 3 is a graph which shows the relationship between the amount of electrical charge of the pressure pad 5 and the amount of electrostatic force which adheres a sheet of recording medium to the pressure pad 5. It shows the effect of the changes in the amount of electrical potential of the pressure pad 5, upon the amount of electrostatic force by which a sheet of recording medium is adhered, and kept adhered, to the pressure pad 5. In the test, the amount of electrostatic force by which a sheet of recording medium is adhered to the pressure pad 5 at a given level of electrical potential which is forcefully applied between the pressure pad 5 and fixation roller 1 by a high voltage power source was measured. More specifically, a sheet of recording paper, which is the same as the one used to test the fixing device in the first embodiment and the first comparative fixing device, was placed on the pressure pad 5. Then, while the potential of the pressure pad 5 is kept at a preset level, the sheet was gently pulled, and the amount force necessary to budge the sheet was measured. As will be evident from FIG. 3, the higher the potential level of the pressure pad 5, the greater the amount of electrostatic force which keeps the sheet of recording medium adhered to the pressure pad 5.

In another test, a sheet of recording paper, which is the same as the one used to test the fixing device in the first embodiment and the first comparative fixing device, is also placed on the pressure pad 5. Then, the sheet was gently pushed from one side of the sheet, with the sheet being held at the other side to prevent the sheet from moving, and the amount of force necessary to cause the sheet to begin to deform (bend) was measured while the potential of the pressure pad 5 is kept at a preset level (hereafter, this force is referred to as "buckling load"). The amount of "buckling load" was 118 gf. It is evident from this test that as the amount of electrostatic force, shown in FIG. 3, which keeps a sheet of recording paper adhered to the pressure pad 5, exceeds the amount of the "buckling load", that is, as the pressure pad 5 is charged to a potential level of roughly 3,800 V or higher, the amount of the electrostatic force exceeds the amount of "buckling load", and therefore, the fixing device fails to properly nip a sheet of recording medium.

Further, in an additional test, the amount of the above described electrostatic force and "buckling load" were measured using various sheets of ordinary paper, which are in a range of 60 g/m$^2$-90 g/m$^2$, instead of the sheet of Business 4200 paper (product of Xerox Co., Ltd.) which is 75 g/m$^2$ in basis weight and was used to test the fixing device in the first embodiment and the first comparative fixing device.

The amount of the buckling load was in a range of 85 gf-150 gf, which is different from the range of the amount of bucking load of the sheet of Business 4200 paper, whereas the amount of the electrostatic force was hardly different from when the sheet of Business 4200 was used. It is evident from the results of the above-described tests that from the standpoint of practicality, the fixation pad 5 is desired to be kept no higher in potential level than 2,000 V.

As will be evident from the description of the first preferred embodiment of the present invention given above, the present invention makes it possible to prevent the stationary pressure applying member of a fixing device from being electrically charged. Therefore, not only can the present invention prevent the problem that a fixing device fails to properly nip a sheet of recording medium, but also, the problem that a fixing device, the material for the pressure applying stationary member of which is a metallic substance, fails to properly convey a sheet of recording medium, and/or contaminates a sheet of recording medium.

Embodiments 2-4, and Second Comparative Fixing Device

The second to fourth preferred embodiments of the present invention, and the second comparative fixing device, are different in the amount of the carbon dispersed in the recording medium backing layer of their pressure pad, being therefore, different in the amount of electrical resistance of the pressure pad 5. More concretely, in order to find the upper limit for the amount of the electrical resistance of the pressure pad 5, four pressure pads were made, which are different in the amount of the electrically resistance. As for the method for making four pads different in the amount of electric resistance, the amount by which carbon (which is for providing pressure pad with electrical conductivity) is dispersed in the PFA resin as the material for the pressure pad is varied. The measured amounts of electrical resistance of the pressure pads in the second, third, and fourth embodiment, and the pressure pad of the second comparative fixing device, were $10^8\Omega$, $10^{10}\Omega$, $10^{12}\Omega$, and $10^{14}\Omega$, respectively. These pads were mounted in a fixing device similar to the one used to test the pressure pad 5 in the first embodiment, and the fixing device was mounted in an image forming apparatus similar to the one in the first embodiment.

Then, 150 sheets of recording paper were conveyed with the use of the same methods as those used to test the pressure pad in the first embodiment, while measuring the amount of the surface potential of each pad and examining whether or not the fixing device failed to properly nip the sheets. The test results were as shown in Table 1. However, the pressure pad which is $10^{14}\Omega$ in the amount of electrical resistance caused the fixing device to frequently fail to properly nip a sheet after the 50th sheet and thereafter. Thus, the value of electrical resistance of this pad shown in Table 1 is the one obtained when the 50th sheet was conveyed.

TABLE 1

| Resistance of Fixing pad | $10^8\Omega$ Embodiment 2 | $10^{10}\Omega$ Embodiment 3 | $10^{12}\Omega$ Embodiment 4 | $10^{14}\Omega$ Comparative Ex. 3 |
|---|---|---|---|---|
| Surface potential of backing layer after 1500 sheets were processed | ≤1000 V | ≤1000 V | Aporox. 2000 V | Approx. 4000 V |
| Improper nipping | no | no | no | Occurred often after 50 sheet |

It is evident from the results of the above described test that the amount of electrical resistance of the pressure pad 5 is desired to be no more than $10^{12}\Omega$. More specifically, the portion of the resin layer (recording medium backing layer) of the pressure pad 5, which corresponds in position to the fixation nip, is desired to no more than $10^{12}\Omega$. Further, in consideration of the nonuniformity in terms of the amount of "buckling load" among various sheets of recording medium, it is desired to be no more than $10^{10}\Omega$.

Embodiments 5 and 6, and Third Comparative Fixing Device

In order to find the bottom limit for the amount of electrical resistance of the pressure pad 5, it is checked whether or not a problem occurs if the pressure pad 5 is lower in the amount of electrical resistance than certain values. More specifically, a resistor which can be varied in the amount of electrical resistance was connected to each of the pressure pads 5 in the fifth and sixth embodiments of the present invention, and the third comparative pressure pad 5, and whether or not a problem occurs as the resistor is reduced in the amount of electrical resistance was checked. The problem with which the inventors of the present invention were concerned was as follows: if a pressure pad is lower in the amount of electrical resistance than a certain value, the voltage applied to the transfer station of an image forming apparatus is allowed to flow to the ground through the fixing device of the apparatus, causing the transfer voltage to drop, causing thereby the apparatus to output an defective image, the defects of which are attributable to transfer error. Incidentally, it has been known that a sheet of recording medium (paper) which was left unattended for a substantial length of time in an ambience which was high in both temperature and humidity is low in volume resistivity, and therefore, is likely to allow transfer current to flow into a fixing device, making it therefore likely to cause an image forming apparatus to output a defective image, the defects of which is attributable to transfer error.

At this point in time, the mechanism which causes an image forming apparatus to suffer from transfer error is described with reference to FIGS. 5 and 6. First, referring to FIG. 5, designated by a referential numeral 102 is a photosensitive drum as an image bearing member, and designated by a referential numeral 106 is a transfer roller as a transferring means. Designated by referential numerals 1 and 5 are fixation roller and pressure pad, respectively. Further, designated by a referential numeral 44 is a current limiting resistor which is in connection to the fixing device to prevent the image forming apparatus to output a defective image, the defects of which is attributable to unsatisfactory transfer. A toner image is formed on the photosensitive drum 102 by an unshown image forming means, and is transferred onto a sheet of recording medium by the application of voltage to the transfer roller 106 by an electrical power source 45. The voltage applied to the transfer roller 106 is opposite in polarity to the toner.

Figure 5:
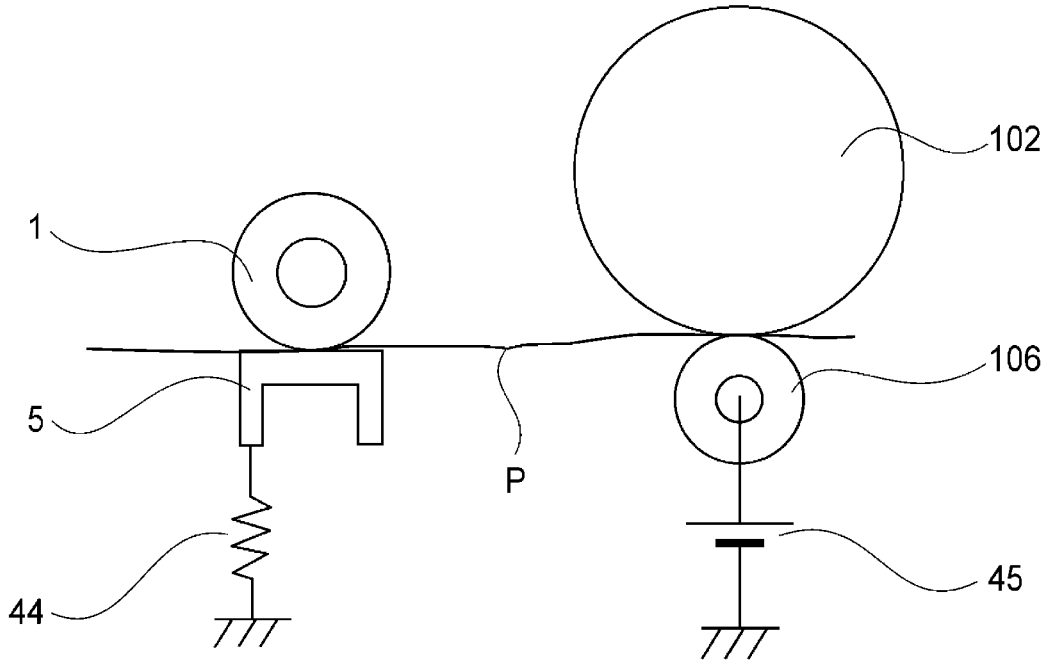
FIG. 5 is a schematic sectional view of the combination of the transfer station and fixing device. It is for describing the mechanism which causes the transfer station to suffer from unsatisfactory image transfer.
Figure 6:
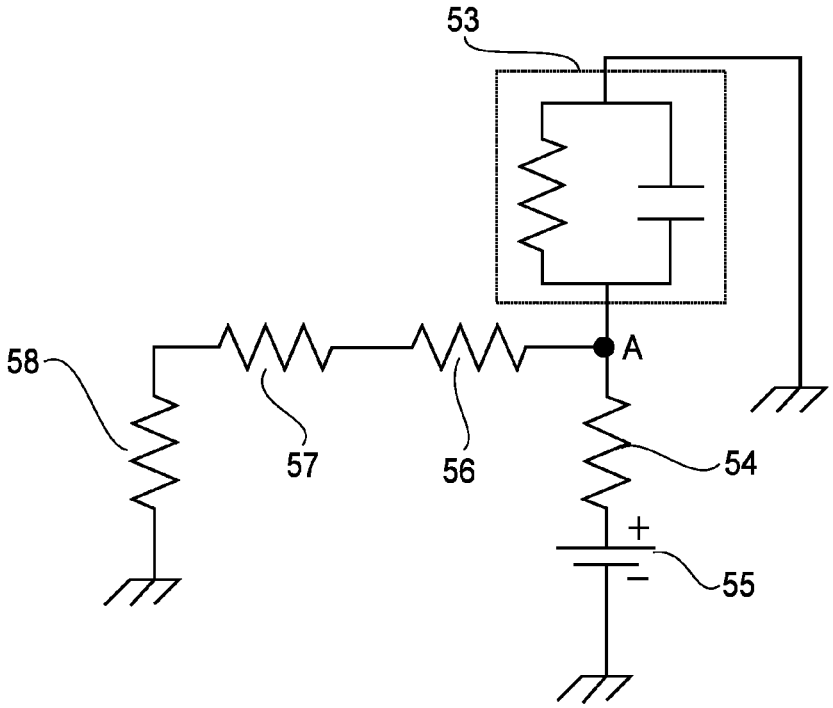
FIG. 6 is an equivalent circuit of the combination of the transfer station and fixing device.

Shown in FIG. 6 is a circuit which is equivalent to the electrical circuitry of the fixing device shown in FIG. 5. In FIG. 6, the photosensitive drum 102 is represented by the combination (53) of a resistor and a condenser, whereas the transfer roller 106 is represented by a resistor 54. Assuming that the amount by which current is provided from the power source 55 remains the same, as the sum of the electrical resistance 56 of the sheet of recording medium, electrical resistance 57 of the pressure pad 5, and electrical resistance of the current limiting resistor 58 reduces, a point A of the equivalent circuit, which corresponds in position to where toner is transferred onto a sheet of recording medium, reduces in potential level. As a result, the point A reduces in the amount of electrostatic force which attracts toner to a sheet of recording medium, causing therefore the image forming apparatus to output a defective image, the defects of which are attributable to the unsatisfactory transfer of toner onto the sheet of recording medium.

In the case of each of the pressure pads in the fifth and sixth embodiments, and the third comparative pressure pad, a substance concocted by dispersing carbon particles in a mixture of PEEK resin and PFA resin was used as the material for the recording medium backing layer of the pressure pad. The amount of electrical resistance of each of these pressure pads was measured with the use of a method similar to the one used to measure the amount of electrical resistance of the pressure pad in the first embodiment. The measured amount of electrical resistance of each pressure pad was 5 kΩ.

In the fifth embodiment, the resistors 44 (FIG. 6), which is 5 MΩ in the amount of electrical resistance, was connected between the pressure pad 5 and GND. In the sixth embodiment, the resistor 44 (FIG. 6), which is 1 MΩ in the amount of electrical resistance was connected between the pressure pad 5 and GND. In the case of the third comparative pressure pad, a resistor 44 which is 100 kΩ in the amount of electrical resistance was connected between the pressure pad and GND. In the tests, a sheet of Business 4024 (product of Xerox Co., Ltd.: 75 g/m$^2$ in basis weight) was reduced in the volume resistivity by being left unattended in an ambience which was high in both temperature (32.5° C.) and humidity (80% RH), and a solid black image, which is large enough to cover the entirety of this sheet was printed on this sheet. Then, the sheet was conveyed through the fixing device to check whether or not the image forming apparatus would output a defective image, the defects of which are attributable to unsatisfactory image transfer. The results of the tests are given in Table 2.

TABLE 2

| Resistance | 5 MΩ Embodiment 5 | 1 MΩ Embodiment 6 | 100 kΩ Comparative Ex. 3 |
|---|---|---|---|
| Properness of transfer | G | F | NG |

In Table 2, "G" indicates that there were no problems attributable to unsatisfactory image transfer, and "F" indicates that the apparatus outputted slightly defective images, the defects of which are attributable to unsatisfactory image transfer, but are not problematic for normal usage. Further, "NG" indicates that the image forming apparatus outputted defective images, the defects of which are serious. It is evident from the test results given in Table 2 that in order to prevent the formation of a defective image, the defects of which are attributable to unsatisfactory image transfer, the sum of the electrical resistance of the pressure pad and the electrical resistance of the current limiting resistor is desired to be no less than 1 MΩ, preferably, 5 MΩ.

As is evident from the above given description of the first to sixth embodiments of the present invention, and the first to third comparative pressure pads, the electrical resistance of the pressure pad is desired to be no more than $10^{12}$Ω. Further, it is in a case where a fixing device is such that the sum of the electrical resistance of its pressure pad, and the electrical resistance of its current limiting resistor connected between the pressure pad and GND, is no less than 1 MΩ that the fixing device can enable an image forming apparatus to output satisfactory images, and also, does not fail to properly nip a sheet of recording medium. In other words, the sum of the electrical resistance of the pressure applying member (pressure pad) and that of the current limiting resistor is desired to be no less than $10^6$Ω and no more than $10^{12}$Ω.

In these embodiments, only a resistor was connected between the pressure pad and GND to limit the amount by which electrical current flows from the transfer station to GND. However, the means for limiting the amount of this current does not need to be limit to a resistor. That is, it may be any electrical element or circuit as long as it is capable of limiting this current.

(Fourth Comparative Pressure Pad)

The recording medium backing layer of the fourth comparative pressure pad is plated with a metallic substance. More concretely, the substrate of this pressure pad is a piece of zinc-coated steel plate, which is the same as the one in the first embodiment. The recording medium backing layer of the pressure pad is a piece of 0.3 mm thick plate of SUS 304 plated with nickel. The recording medium backing layer was solidly attached to substrate with the use of adhesive. The pressure pad was set in a laser beam printer which is similar to the one in the first embodiment.

The fourth comparative pressure pad also was subjected to the same tests as those used to test the preceding pressure pads. The first 100 sheets of recording medium were normally conveyed through the fixing device. Thereafter, however, it became difficult for the sheets to be conveyed through the fixing device: paper jam frequently occurred. After the tests, the fixing device was disassembled to examine the surface of the pressure pad 5. The examination revealed the presence of toner particles having adhered to the surface. Thus, it seemed reasonable to think that not only did these toner particles having adhered to the surface of the pressure pad 5 interfere with the recording medium conveyance, but also, frequently caused paper jam.

It is evident from the results of the above described tests that it is only a pressure pad, the recording medium backing layer of which is electrically conductive, that can make it possible to provide a fixing device which is satisfactorily durable in terms of recording sheet nipping performance and recording medium conveyance performance.

Embodiment 7

Figure 7:
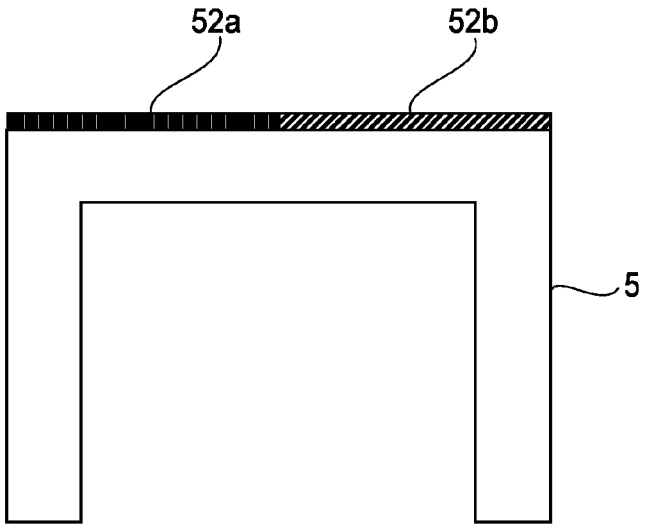
FIG. 7 is a schematic sectional view of the pressure pad in the seventh preferred embodiment of the present invention, at a plane perpendicular to the lengthwise direction of the pressure pad.

FIG. 7 is a sectional view of the pressure pad in the seventh preferred embodiment of the present invention. The pressure pad in this embodiment is similar to the one in the first embodiment in that in terms of the recording medium conveyance direction, the upstream portion (relative to the fixation nip) of the recording medium backing layer of its pressure pad, which is responsible for the nipping of a sheet of recording medium, is electrically conductive as is the counterpart in the first embodiment. In this embodiment, however, the downstream portion of the pressure pad is electrically nonconductive. That is, in this embodiment, the upstream and downstream portions of the recording medium backing layer of the pressure pad are made different in function in order to further improve the pressure pad in recording medium conveyance performance. More specifically, the upstream portion of the recording medium backing layer of the pressure pad relative to the nip, is formed of electrically conductive resin. That is, in terms of the recording medium conveyance direction, the upstream portion of the recording medium backing layer of the pressure pad, relative to the fixation nip which the pressure applying member forms between itself and the rotational heating member, is formed of a mixture of resin, and particles of electrically conductive substance dispersed in the resin. In comparison, the downstream portion of the recording medium backing layer of the pressure pad in this embodiment, in terms of the recording medium conveyance direction, relative to the fixation nip, is formed of a resinous substance which is greater in volume resistivity than the upstream portion.

On the entrance side of the fixation nip, what is important in the performance of a fixing device is nipping of a sheet of recording medium. Therefore, the upstream portion of the recording medium backing layer of the pressure pad needs to be higher in electrical conductivity, whereas on the exit side of a fixation nip, a sheet of recording medium is strongly and persistently pushed by the fixation roller, and therefore, the downstream portion of the recording medium backing layer of the pressure pad is not necessarily required to be electrically conductive. With the employment of this structural arrangement described above, it is ensured that a sheet of recording medium is reliably discharged while being kept flat on the recording medium backing layer of the pressure pad by the electrostatic force. On the other hand, on the downstream side of the fixation nip, such paper jam that is attributable to the wrapping of a sheet of recording medium around the fixation roller is of more serious concern.

To sum up the characteristic features of this embodiment, in order to ensure that a sheet of recording medium is properly nipped by the fixation nip, the upstream portion of the recording medium backing layer of the pressure pad relative to the fixation nip is made electrically conductive, whereas the downstream portion of the recording medium backing layer is made electrically nonconductive, in order to keep a sheet of recording medium flat on the recording medium backing layer by the electrostatic force to prevent the sheet of recording medium from wrapping around the fixation roller.

The recording medium backing layer of the pressure pad 5 in this embodiment is similar to the counterpart in the first embodiment except for a minor difference. That is, in terms of the recording medium conveyance direction, the downstream portion 52*a* of the recording medium backing layer 52 in this embodiment is different from the upstream portion 52*b* in that the former is formed of an electrically conductive substance, such as the one used in the fourth embodiment, created by dispersing carbon particles in PEEK resin, whereas the latter is formed of plain PEEK resin, which is electrically nonconductive. Further, a resistor which is 5 MΩ in electrical resistance was connected as a current limiting resistor to the fixing device.

The following test was performed to find out how easily a sheet of recording medium is likely to wrap around the fixation roller, on the exit side of the fixing device. That is, a solid black image which is large enough to cover a sheet of OHT (Overhead Projector Transparency: sheet of transparent resin) from one lateral edge of the sheet to the other was printed on a sheet of OHT in such a manner that the leading edge of the solid black image would be 50 mm away from the leading edge of the sheet. Then, the sheet was conveyed through the fixing device. In the case of the fixing device in the first embodiment, the fixing device was jammed by the sheet as the sheet wrapped around the fixation roller 1, whereas the fixing device in this embodiment was not jammed by the sheet of OHT, proving that the fixing device in this embodiment is superior in recording medium conveyance to the fixing devices in the first embodiment.

In each of the first to seventh embodiment of the present invention, the material for the substrate of the pressure pad was metallic. However, the substrate may be formed of electrically conductive resin, as an integral part of a one-piece pressure pad, with absolutely no ill effect. In a case where the substrate is formed as an integral part of a pressure pad, the entrance guide and exit guide of a fixing guide also may be formed as integral parts of a pressure pad so that the pressure pad can double as the sheet guiding members of a fixing device. With the employment of such a structural arrangement, it is possible to provide a fixing device which is more accurate in the positioning of the recording medium conveyance guides, and therefore, can more reliably convey a sheet of recording medium than any of the fixing devices in the preceding embodiments.

Further, a pressure pad, such as the pressure pad 5 in the seventh embodiment, the entrance side of which relative to the fixation nip is different in electrical resistance from its exit side, may be formed by combining two sub-components molded of a resinous substance, which are different in electrical resistance. In addition, such a pressure pad may be structured so that it doubles as the entrance guide and exit guide of a fixing device.

In the seventh embodiment, in terms of the recording medium conveyance direction, the upstream portion of the recording medium backing layer of the pressure pad relative to the fixation nip was electrically conductive, whereas the downstream portion was dielectric. However, the seventh embodiment is not intended to limit the present invention in scope. That is, all that is necessary to prevent a sheet of recording medium from wrapping around the fixation roller is to design a pressure pad so that the downstream portion of the recording medium backing layer of the pressure pad, in terms of the recording medium conveyance direction, is greater in the amount of electrical resistance than the upstream portion.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 206633/2010 filed Sep. 15, 2010 which is hereby incorporated by reference.

What is claimed is:

1. An image heating device comprising:

a heating rotatable member; and a pressing pad contacting said heating rotatable member and forming a nip with said heating rotatable member to nip and feed a recording material, said pressing pad being provided with an electroconductive material that is dispersed in a resin material layer contacting said heating rotatable member, and said pressing pad being provided with a layer which contacts said heating rotatable member in a region downstream of the nip and which has a volume resistivity higher than that in a region upstream of the nip.

2. A device according to claim 1, wherein the resistance of a region of said resin material layer forming the nip is not more than 1012Ω.

3. A device according to claim 2, wherein said pressing is grounded through a limiting resistor, and the combined resistance of said pressing pad and said limiting resistor is not less than 106Ω and not more than 1012Ω.

4. An image heating device comprising:

a heating rotatable member; and a pressing pad contacting said heating rotatable member and forming a nip with said heating rotatable member to nip and feed a recording material, said pressing pad being provided with an electroconductive material that is dispersed in a resin material layer contacting said heating rotatable member in a region upstream of the nip with respect to a feeding direction of the recording material, said pressing pad being provided with a layer which contacts said heating rotatable member in a region downstream of the nip and which has a volume resistivity higher than that in a region upstream of the nip.

* * * * *